United States Patent [19]

Fetters et al.

[11] Patent Number: 4,530,702

[45] Date of Patent: Jul. 23, 1985

[54] METHOD FOR PRODUCING FUEL GAS FROM ORGANIC MATERIAL, CAPABLE OF SELF-SUSTAINING OPERATION

[75] Inventors: Wayne A. Fetters, Canby; Donald E. Chittick, Newberg, both of Oreg.

[73] Assignee: Pyrenco, Inc., Prosser, Wash.

[21] Appl. No.: 353,570

[22] Filed: Mar. 1, 1982

Related U.S. Application Data

[63] Continuation of Ser. No. 178,179, Aug. 14, 1980, abandoned.

[51] Int. Cl.[3] ..... C10J 3/14

[52] U.S. Cl. ..... 48/209; 48/203

[58] Field of Search ..... 48/203, 209; 252/373

[56] References Cited

U.S. PATENT DOCUMENTS

| | | | |
|---|---|---|---|
| 926,729 | 7/1909 | Crossley et al. | 48/203 |
| 1,273,474 | 7/1918 | Fleischer | 48/203 |
| 3,746,521 | 7/1973 | Giddings | 48/209 |

*Primary Examiner*—Peter Kratz

*Attorney, Agent, or Firm*—Cole, Jensen & Puntigam

[57] ABSTRACT

The apparatus includes a reaction chamber which in operation uses an organic fuel input, typically in the form of substantially uniform-sized pellets, to produce a tar-free fuel gas. Prior to initiating operation, the lower end of the reaction chamber is filled with a charge of charcoal, forming a charcoal bed. A portion of the charcoal bed is then ignited, typically near the top, with air from the atmosphere being drawn substantially uniformly down through the reaction chamber by a pump on the outlet line leading from the reaction chamber, creating a thin pyrolysis zone near the top of the charcoal bed. The substantially uniform-size fuel pellets are added to the top of the charcoal bed, and are pyrolized as they move down through the pyrolysis zone. Since the fuel pellets are substantially uniform in size, and since the air-flow down through the chamber is substantially uniform, the temperature profile over the cross-sectional area of the pyrolysis zone is substantially uniform, and a homogeneous pyrolysis zone is created, without hot spots or channels. Such an arrangement results in self-regulating, self-sustaining operation over a relatively wide demand range, with rapid start-up and response characteristics. Air may also be directed into the reaction chamber through an inlet beneath the charcoal bed, which results in the reaction of the devolatilized charcoal to form additional fuel and an ash residue. Thus, the production and consumption of the charcoal within the apparatus may be exactly balanced.

11 Claims, 10 Drawing Figures

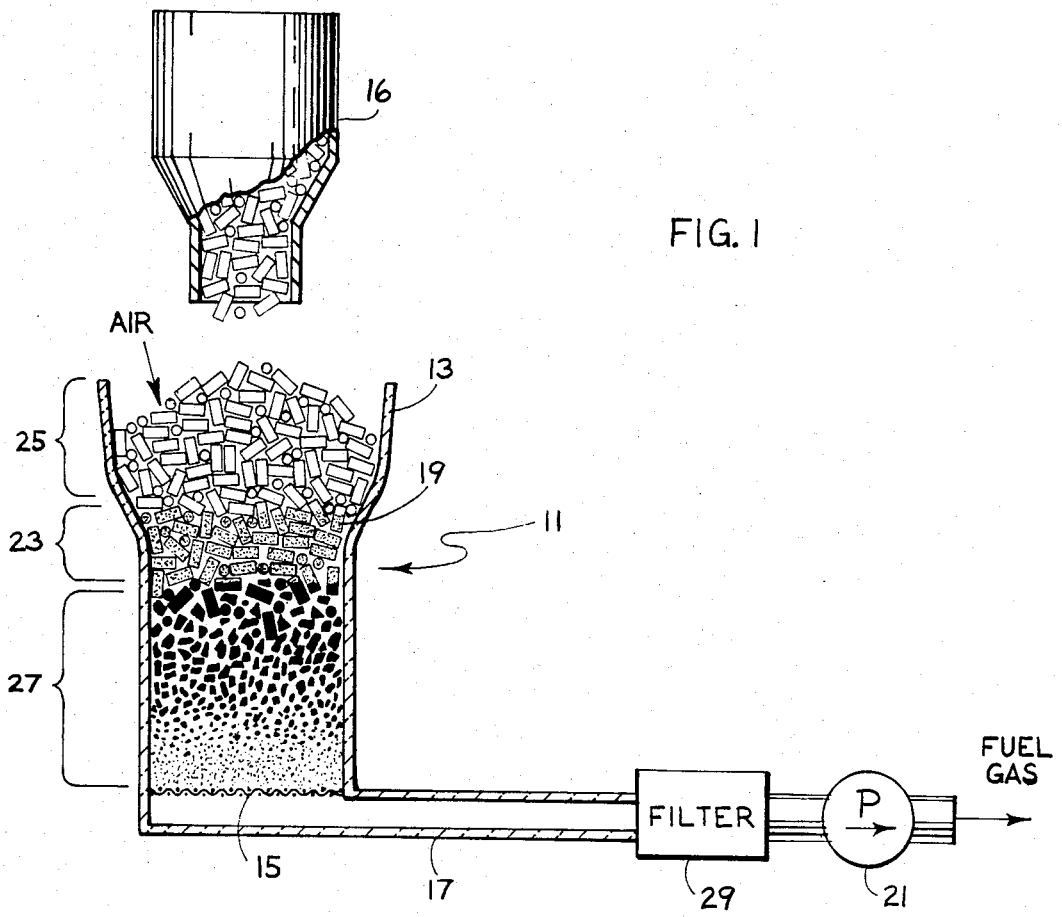
FIG. 1
FIG. 2
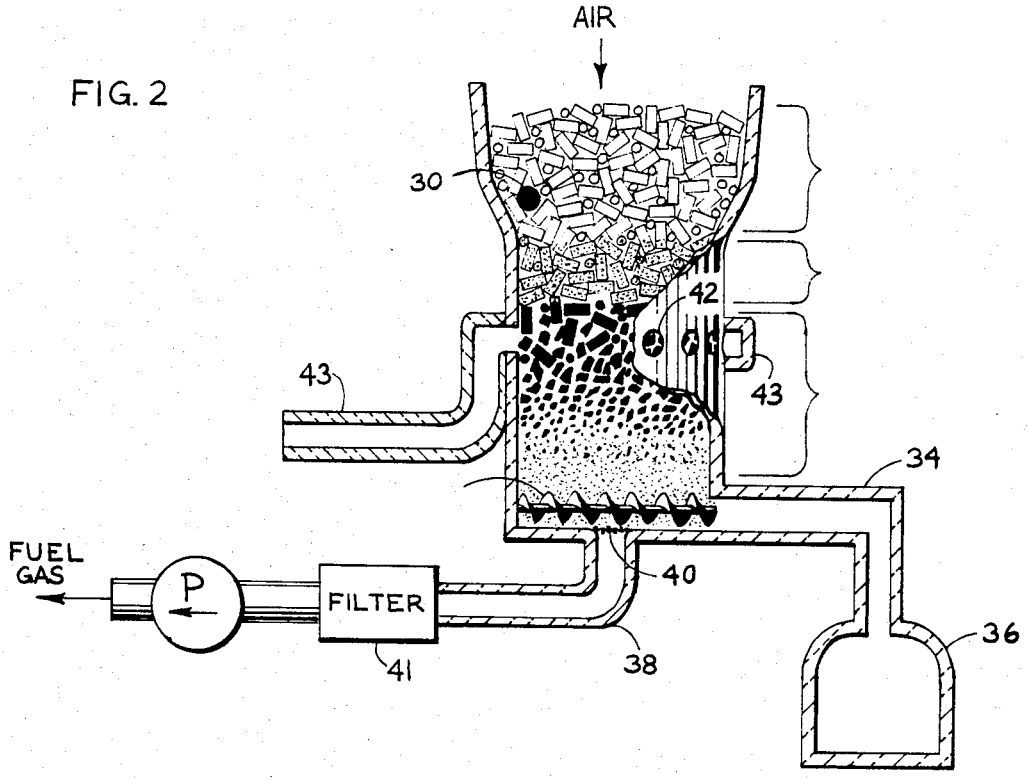

METHOD FOR PRODUCING FUEL GAS FROM ORGANIC MATERIAL, CAPABLE OF SELF-SUSTAINING OPERATION

This is a continuation of application Ser. No. 178,179, filed Aug. 14, 1980 now abandoned.

BACKGROUND OF THE INVENTION

This invention relates generally to the art which is concerned with producing fuel gas from organic material, and more particularly concerns an apparatus and method in such art which is self-sustaining in operation.

The use, per se, of a pyrolysis process to convert organic material, such as wood chips, to fuel gas and charcoal is well known, and a wide variety of devices have been designed to accomplish such a result. A primary disadvantage of such devices, which are generally referred to as gasifiers, is that a typical by-product of the pyrolysis process is a large quantity of tars, which affect both the operation of the gasifier, eventually clogging it, and the end use apparatus of the gas, such as an internal combustion engine or other burner of some kind. This problem is particularly prevalent in portable gasifiers, which are generally known as gasogens. The problem is discussed in detail in application Ser. No. 018,118, filed Mar. 7, 1979, now U.S. Pat. No. 4,268,275, titled: Apparatus and Method for Converting Organic Material Into Fuel, by the same inventor named on this application. The solution disclosed in that application included a reaction chamber having a pyrolysis zone followed by a reaction zone comprising a bed of charcoal heated to a high temperature. The high temperature of the charcoal and the catalytic effect of the ash residue on the surface of the hot charcoal break down the tars from the pyrolysis zone into carbon monoxide and hydrogen. The heat for the pyrolysis zone and the reaction zone was provided externally.

Such a unit, which is effective and useful in many applications, is not particularly useful in a portable mode, i.e. such as on a vehicle. Also, the start-up time and response to demand of such units are typically very slow, significant disadvantages in a portable unit. Also, the proper operation of most gasifiers is confined to rather narrow parameters, and even then is somewhat unpredictable, as such units are still prone to produce tar, and are subject to additional problems such as channeling and clinkering. Such units typically operate best at a steady state, rather than with a variable demand. Further, such units typically produce an excess of charcoal, which requires monitoring and removal systems, and which can lead to more serious operational problems. Hence, for many applications, particularly those requiring a portable unit, conventional gasifiers are impractical economically and therefore at the present time have a rather low market significance.

Accordingly, it is a general object of the present invention to provide a method and apparatus for producing fuel gas from organic material which overcomes one or more of the disadvantages of the prior art noted above.

It is another object of the present invention to provide such a method and apparatus which is specifically adapted to be portable, and hence may be conveniently used on a vehicle.

It is an additional object of the present invention to provide such a method and apparatus which is characterized by a relatively rapid start-up time.

It is yet another object of the present invention to provide such a method and apparatus which is characterized by a relatively rapid response to changes in demand.

It is a still further object of the present invention to provide such a method and apparatus which is capable of operating satisfactorily over a relatively wide range of demand.

It is an additional object of the present invention to provide such a method and apparatus which produces tar-free fuel gas, and which is not prone to clinkering or channeling.

SUMMARY OF THE INVENTION

Accordingly, the present invention includes a process for producing fuel gas from organic material, in which a charge of charcoal is initially present in a pyrolysis reaction chamber, thus forming a charcoal bed therein, the process being self-sustaining so that it does not require the addition of external heat following initiation of the process, wherein the process comprises the steps of: igniting a portion of the charcoal bed, the ignition being substantially uniform over the cross-sectional area of the charcoal bed; moving air through the charcoal bed so that the portion of ignited charcoal becomes sufficiently hot to create a pyrolysis reaction zone in the charcoal bed; adding organic material, typically in the form of pellets or chips or the like, to the reaction chamber on top of the charcoal bed; forming a head of raw unreacted fuel; and establishing and maintaining a zone in the pyrolysis zone in which the combustion is homogeneous, the zone of homogeneous combustion extending over the entire cross-sectional area of the pyrolysis zone. In a further development, the steps of igniting, moving and adding, and with and without the steps of establishing and maintaining, the step of directing additional air into the charcoal from beneath the charcoal bed is added, providing a capability to balance the production and consumption of charcoal within the apparatus.

Further, the present invention includes an apparatus for converting a biomass input to an output gas which is suitable for use as a fuel, wherein the apparatus includes an inner reaction chamber which is open at its lower end, in which, in operation, a bed of charcoal is present in which in turn is located a pyrolysis reaction zone. The pyrolysis reaction converts the biomass input into fuel gas volatiles and charcoal. An outer reaction chamber extends outwardly from and surrounds a substantial portion of the inner reaction chamber, such that a space exists between the sides of the inner and outer reaction chambers and between the bottom of the outer reaction chamber and the bottom edge of the inner reaction chamber. In a further development, for use with any gasifier apparatus, including the one above, in which air is drawn down through the reaction chamber from above the pyrolysis zone and gas exits from the apparatus a substantial distance above the bottom of the charcoal bed, an air inlet line is positioned so that additional air is directed into the charcoal bed from below the bed.

Still further, the present invention includes a control valve for use on gas output lines which includes a means for sampling the gas pressure in the output line; control valve means positioned in a return line which, when open, permits recirculation of a portion of the gas in the output line; and control means responsive to the pressure in the output line, as sampled by the sampling means, to open the normally closed valve means when the pressure rises above a predetermined valve.

DESCRIPTION OF THE DRAWINGS

A more thorough understanding of the invention may be obtained by a study of the following detailed description taken in connection with the accompanying drawings in which:

FIG. 1 is a simplified cross-sectional diagram of one embodiment of a gasifier in which the method of the present invention may be carried out.

FIG. 2 is a simplified cross-sectional diagram of a variation of the embodiment of FIG. 1.

DESCRIPTION OF THE PREFERRED EMBODIMENT

Figure 3:
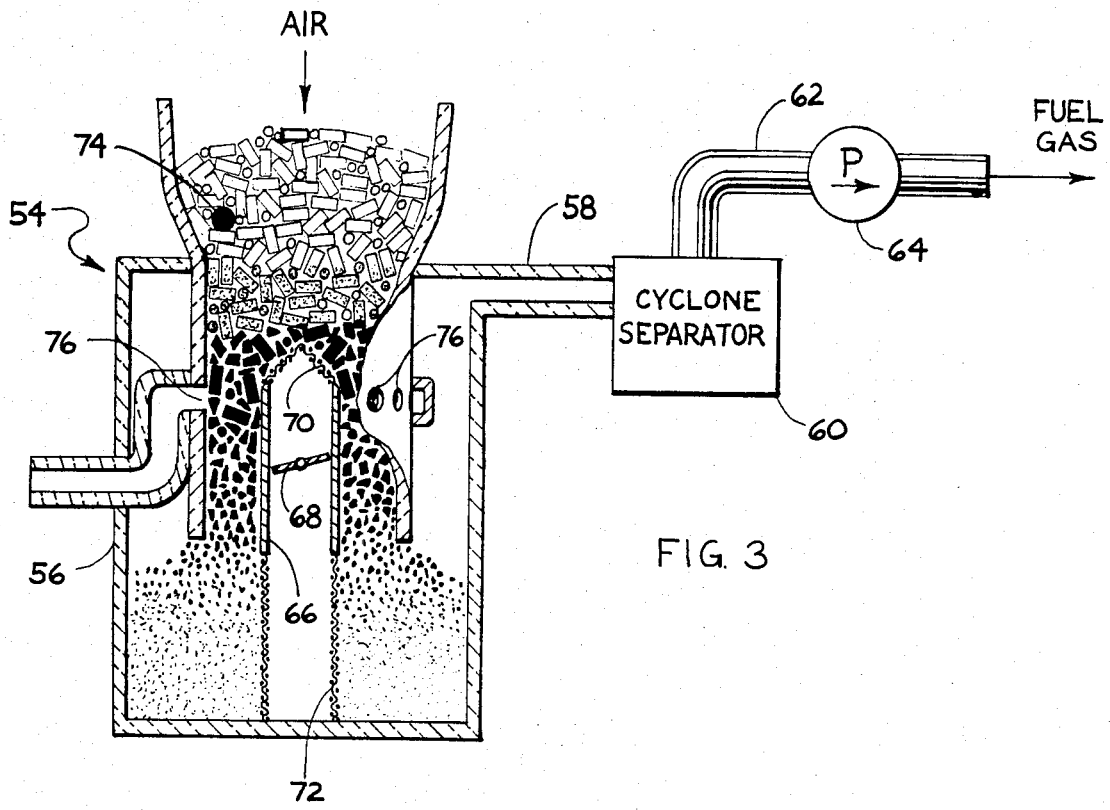
FIG. 3 is a simplified cross-sectional diagram of an additional embodiment which incorporates additional structural features beyond that of the embodiment of FIG. 1.

FIG. 1 shows one embodiment of the present invention, which in operation is self-sustaining, in that it requires no external heat source to maintain operation, and thus is appropriate for mobile applications, such as in a vehicle. The reaction chamber shown generally at 11 comprises a fiber-ceramic insulating material, lined interiorly with unreactive inconel or stainless steel metal, either of which resist attack from oxygen. Typically, but certainly not necessarily, the reaction chamber will be circular in cross-section. Its diameter may vary over a wide range, from rather small, i.e. 2 inches, to quite large, at least several feet and even larger.

The diameter of the embodiment of FIG. 1 is substantially uniform along its length, except for the uppermost portion 13, which may be slightly flared to accommodate a head of fuel pellets, which are fed into the reaction chamber from a hopper 16. Near the bottom of the reaction chamber 11 is a horizontal screen 15 which supports the charcoal and fuel in the reaction chamber and permits exit of the fuel gas from the chamber. An exit line 17 leads from the reaction chamber 11 at the lower end thereof, beneath the screen 65.

Prior to initiation of operation, the chamber 11 is filled to the point labeled 19 with devolatilized charcoal or coke, i.e. charcoal from which tars and volatiles have been removed. The devolatilized charcoal is substantially uniform in size and configuration, as explained in more detail hereinafter, although the particular size of the charcoal will depend to an extent on the size of the reaction chamber.

The charcoal bed is then ignited, typically, but not necessarily, at or near the top thereof by a torch, electric start, or similar device. Atmospheric air is moved downwardly through the reaction chamber by means of a pump 21 which is typically located in exit line 17 so that air is drawn into and through the reaction chamber from the atmosphere above the reaction chamber because the pressure in the reaction chamber is less than atmospheric. Alternatively, a source of pressurized air may be used at the top of the reaction chamber to force air through the reaction vessel and out exit line 17.

It is important for tar-free operation of the gasifier that the combustion reaction in the pyrolysis zone be substantially homogeneous over the cross-sectional area of the reaction chamber. This means that the temperature profile across the pyrolysis zone, over the cross-section of the reaction chamber, should be substantially uniform, so that there are no hot spots or channels in the pyrolysis zone. Maintaining a homogeneous pyrolysis zone results in the pyrolysis zone being relatively thin, no matter what the size of the reaction chamber. Any tars which are produced in such a pyrolysis zone are rather light in weight and are completely broken down by the hot charcoal bed below the pyrolysis zone.

The pyrolysis reaction is homogeneous in the embodiments shown largely because the airflow through the reaction chamber is substantially uniform over the cross-sectional area of the chamber, particularly over the pyrolysis zone, labeled 23 in FIG. 1. Thus, a uniform pressure exists over the cross-sectional area of the chamber 11 in the embodiments shown. To insure that this occurs, the structure by which air is provided to the reaction chamber should not be such as to channel air into the reaction chamber, such as occurs with tuyeres, for instance. Air must be permitted to disperse evenly over the top of the raw fuel head and to be drawn down uniformly through the head. Further, the size of both the fuel pellets, and the charcoal in the charcoal bed should be somewhat uniform in size. Typically, the pellet fuel input will be cylindrical in configuration, of similar diameter, with varying lengths. A certain amount, i.e. 10%–25% or so, of input "dust", i.e. very fine particles, with the pellets, will typically not detrimentally affect the operation of the gasifier. The actual size of the pellets will also vary depending on the size of the reaction chamber. For a 16 inch diameter unit, for example, the size range of the pellets might be in the range of 1/16th inch to $\frac{3}{4}$ inches in diameter, while for a 2 inch diameter unit, the size of the pellets should be 1/16th to $\frac{1}{4}$ inch in diameter. The length of the pellets is not overly significant, as the pellets tend to break into shorter lengths during pyrolysis in any event. Typically, the pellets are in $\frac{1}{4}$ inch to 1 inch lengths. Configurations other than cylindrical could be used, but good results have been obtained with the cylindrical configuration. The uniform size pellets help to insure a uniformity of airflow through the chamber, at least over the cross-sectional area of the pyrolysis zone 23. This in turn assists in maintaining a uniform temperature profile over the cross-sectional area of the reaction chamber in the vicinity of the pyrolysis zone, which minimizes localized hot spots and/or channels in the pyrolysis zone, thus resulting in a homogeneous combustion of the fuel pellets throughout the pyrolysis zone.

It should be understood that additional techniques, perhaps involving screens or other gas dispensing devices, may be used to insure uniformity of airflow through the chamber and a uniform temperature profile. Further, although atmospheric air has been used as an example of the gas which is moved through the chamber, it should be understood that other gases, including oxygen-enriched atmospheric air, or pure oxygen, could be used.

The establishment of a pyrolysis zone with homogeneous combustion is assisted by stirring the charcoal bed following ignition. As mentioned above, the resulting pyrolysis zone is relatively thin, i.e. 2 inches, regardless of the size of the reaction chamber, and has a temperature of approximately 900° C. Typically, the time necessary for uniform ignition of the charcoal bed, and for establishment of the pyrolysis zone, is very short, i.e. a few minutes. After the pyrolysis zone has been established, fuel pellets are fed into the reaction chamber, on top of the charcoal bed, so that three zones are established in the chamber; specifically, the thin, hot pyrolysis zone 23 between the head of cool, unreacted fuel pellets 25 and the charcoal bed 27.

The fuel pellets, once they reach the pyrolysis zone, are reacted by the high temperature to produce charcoal and essentially tar-free fuel gas. The temperature of the exiting gas is typically 50° C. to 100° C. below the temperature of the pyrolysis zone, depending on radiation loses. The fuel gas is essentially tar-free because there are no localized inhomogeneities in the combustion in the pyrolysis zone, such as hot or cool channels, through which the tars from the fuel pellets could otherwise escape and combine into heavy tars. With homogeneous combustion in the pyrolysis zone, any tars emanating from the fuel pellets are light, and the tar molecules are small. These light tars, in the absence of channels or a long pyrolysis zone, such as in the case with applicant's invention, are then reacted by the catalytic action of the hot charcoal bed to form carbon monoxide and hydrogen. Thus, the gas output of applicant's invention is reliably tar-free.

As the fuel pellets move through the pyrolysis zone, which is typically at a temperature of approximately 900° C. but which can operate effectively over a temperature range of 750° C. to 1000° C., fuel gas is produced and a devolatilized char is left behind. Thus, the boundary line between the pyrolysis zone 23 and the charcoal bed 27 is where the fuel pellets have been reduced to devolatilized char.

After a short period of operation, the temperature of the charcoal bed 27 becomes quite hot, typically in the range of 800° C. to 950° C. Any tars which do escape from the pyrolysis zone, which are light, as explained above, are broken down by passage through the hot charcoal bed, so that fuel gas exiting through line 17 is substantially free from tars. In many known gasifiers, on the other hand, the inhomogeneities in the pyrolysis zone result in the tars polymerizing into large, heavy molecules, which move through channels in the material in the gasifier and exit with the gas. The ash and other fines which are created by the operation of the system of the present invention are carried out with the gas and removed by filter 29, which may, for instance, be a cyclone separator.

Because the pyrolysis zone is relatively thin, and substantially homogeneous in reaction, ignition and initiation of operation of the gasifier may be accomplished rapidly, typically much faster than with conventional gasifiers. The unit is also very responsive to changes in demand. The volume of gas output from the gasifier is proportional to the quantity of airflow through the unit, as a change in the air-flow causes a corresponding change in the rate of fuel consumed, and hence, the amount of gas produced.

Another advantage of the homogeneous pyrolysis zone described above is that the unit is stable in operation, i.e. it produces a usable, tar-free output over a relatively wide range of input and output demands. Various kinds of material may be used as input, including wood, straw, and other organic materials, as long as the above size and configurational requirements are observed. The unit is to an extent self-correcting in operation. If an inhomogeneity occurs, additional heat will typically be produced in the vicinity of that inhomogeneity. The additional heat then disperses over the entire pyrolysis zone, tending to disperse the inhomogeneity.

The homogeneity of the reaction of the pyrolysis zone, including the substantially uniform temperature profile, as due in the embodiments shown to the substantial uniformity in size and configuration of the fuel pellets and the uniformity in airflow over the cross-sectional area of the reaction chamber, substantially eliminates hot spot channels which characterize the operation of previous gasogens. Any tars generated in the pyrolysis zone of the gasifier disclosed herein, are lightweight, small molecules, as described above, and are broken down in a catalytic reaction by contact with the devolatilized charcoal in the hot charcoal bed.

Even with a homogeneous radiation condition over the cross-section of the pyrolysis zone, however, the gasifier can be over-driven to the extent that channels are created in the pyrolysis zone and the charcoal bed, resulting in tars and clinkering. Thus, the velocity of the air moving through the unit is important to proper operation of the gasifier. In some instances, the gasifier is more tolerant of differences in size of the input, when the velocity is low. As the velocity of the air increases, size uniformity of the input becomes more significant. The inventors have found that a velocity of 0.27 cubic ft. of air per minute per sq. inch of cross-sectional area provides a good output without overdriving the unit. A reasonable range of air velocity including the above value will provide satisfactory results.

With certain kinds of input, the relative dimensions of the three zones will remain substantially stable within the chamber, with the consumption of charcoal occurring at approximately the same rate as char is produced from the fuel pellets in the pyrolysis zone. However, with most types of fuel inputs, such as dry wood pellets, more charcoal is produced by the pyrolysis reaction then is consumed in the charcoal bed. In such a case, the level of the charcoal bed gradually rises, raising the pyrolysis zone with it. At some point then, charcoal must be removed from the chamber if proper operation is to continue. The excess charcoal can be removed in a number of ways, either mechanically, or by changing fuel to one with a high moisture content so that more charcoal is consumed than is produced by pyrolysis, or by the addition of water or steam to the reaction chamber.

FIG. 2 shows an embodiment which is capable of handling a charcoal buildup. In fact, the unit of FIG. 2 can be used to produce charcoal. The generation of charcoal is highest when the gasifier is operating at a low fuel gas production rate. The charcoal produced, however, is very clean and high quality, without the simultaneous production of tars, smoke or other volatiles, which occur in current charcoal producing apparatus.

The embodiment of FIG. 2 is substantially similar in basic design to that of FIG. 1, with the exception of its charcoal-removing capability. A thermocouple 30 is positioned in the area, zone 25, in which the unreacted raw fuel pellets are located, which is above the pyrolysis zone 23 when the operation of the gasifier is initiated. If charcoal buildup occurs during operation of the gasifier to the extent that the pyrolysis zone reaches the area of thermocouple 30, an auger 32, located at the bottom of the chamber, is initiated by means of an electrical relay or the like (not shown).

The turning of the auger moves the charcoal at the bottom of the chamber, plus any ash and fines, through an exit duct 34 into an air-tight container 36, from which they may be removed when convenient. The auger continues operation until sufficient charcoal has been removed to move the pyrolysis zone 23 downwardly so that the thermocouple 30 cools, and breaks contact. The fuel gas exits from the chamber through an exit line 38, which is protected from charcoal, ash, etc. by a fine mesh screen 40. A filter 41 removes any ash which exits with the gas.

Additional control over charcoal buildup is provided by the addition of steam or water to the charcoal bed 27 through an annular set of openings 42 in the wall of the reaction chamber. The steam is delivered to the openings through a line 43 and manifold 45. When steam enters the hot charcoal bed, it passes downward through the hot charcoal, converting it to carbon monoxide and hydrogen, thereby increasing the rate of consumption of the charcoal. Although the apparatus of FIG. 2 is useful in producing a high quality, tar-free fuel gas, it is also useful in producing a high quality charcoal, particularly when the apparatus is operating in a minimal fuel gas output mode.

The operating range of the embodiments of FIGS. 1 and 2 is quite wide, without the need for complex and delicate control mechanisms, such as are needed with most current gasifiers. Even with a minimum airflow, corresponding to a minimum demand, the temperature in the pyrolysis zone 23 is still sufficiently high, i.e. at least 700° C., to prevent the presence of tars in the output fuel gas. Further, as the airflow increases, the temperature in the pyrolysis zone is prevented from exceeding an upper limit, i.e. 950° C., at which temperature clinkers begin to develop, because of the steam which is released from the fuel pellets during pyrolysis, or steam which may be introduced indirectly from outside the reaction chamber. The faster the rate of fuel consumption, the greater the quantity of steam which is released from the pellets, thus tending to maintain the temperature in the safe region.

Hence, the operation of the present invention is self-regulating over a relatively wide range of demand, from an idle condition to a high output, without the quality of the fuel gas or the operation of the gasifier being adversely affected.

FIG. 3 is another embodiment, somewhat similar to the embodiments of FIGS. 1 and 2, which is directed more specifically to correcting the problem of fines and ash accumulating in the apparatus, which eventually severely interferes with its proper operation. A reaction chamber 54 is similar in general configuration to that shown in FIG. 1, except that it does not have a bottom. An insulated jacket 56 extends around the reaction vessel from an upper boundary where it contacts the reaction vessel in the vicinity of the lower end of the raw pellet fuel head to a lower boundary which extends beneath the reaction zone and is at least two inches below the bottom of the reaction vessel. There is a space of approximately 2 inches in the embodiment shown between the insulated jacket 56 and the walls of the reaction vessel 54. An exit line 58 is provided at the upper end of the insulated jacket, which leads to a conventional cyclone separator 60, from which exit gas is directed through tube 62. A pump 64 maintains the required air movement through the unit.

A tube-like enclosure 66, approximately 2 inches in diameter for an 8 inch diameter reaction chamber, is positioned within the unit, extending vertically upward from the bottom of the insulated jacket, to a point a few inches below the pyrolysis zone. A control valve 68 is provided in enclosure 66. The top portion 70 of the enclosure is a screen, in the shape of a cone, while the bottom portion 72 of the enclosure, approximately 6 inches in length, is also a screen. In the operation of the gasifier shown in FIG. 3, the excess charcoal produced by the pyrolysis reaction mounds around the enclosure 66 at the bottom of the insulated jacket 56 and up the sides of the insulated jacket.

Ash and fines tend to collect in the area between the enclosure 66 and the walls of the reaction chamber 54, thereby inhibiting the free flow of air and fuel gas through the charcoal to the exit line 58. As this occurs, however, a substantial portion of the fuel gas produced in the pyrolysis zone will pass through the top screen portion 70 into the interior of the enclosure 66 and then out through the bottom screen portion 72. The flow of the fuel gas is outward from the bottom of the enclosure and then upward between the jacket 56 and the wall of the reaction chamber 54, which tends to remove fines from the charcoal and out of the apparatus through exit line 58. The heavier charcoal particles remain in the chamber; it is only the lighter fines and ash which are removed. The ash and fines proceed with the fuel gas through exit line 58 and are separated from the gas by the conventional cyclone separator 60.

As in the embodiment of FIG. 2, a thermocouple 74 senses a rise in the level of the pyrolysis zone, caused by a rise in the level of charcoal. This is corrected by introducing steam through an annular series of openings 76. The steam can be generated by using exit line 58 as a heat exchanger to heat incoming water and air to steam prior to injection into the chamber.

Figure 4:
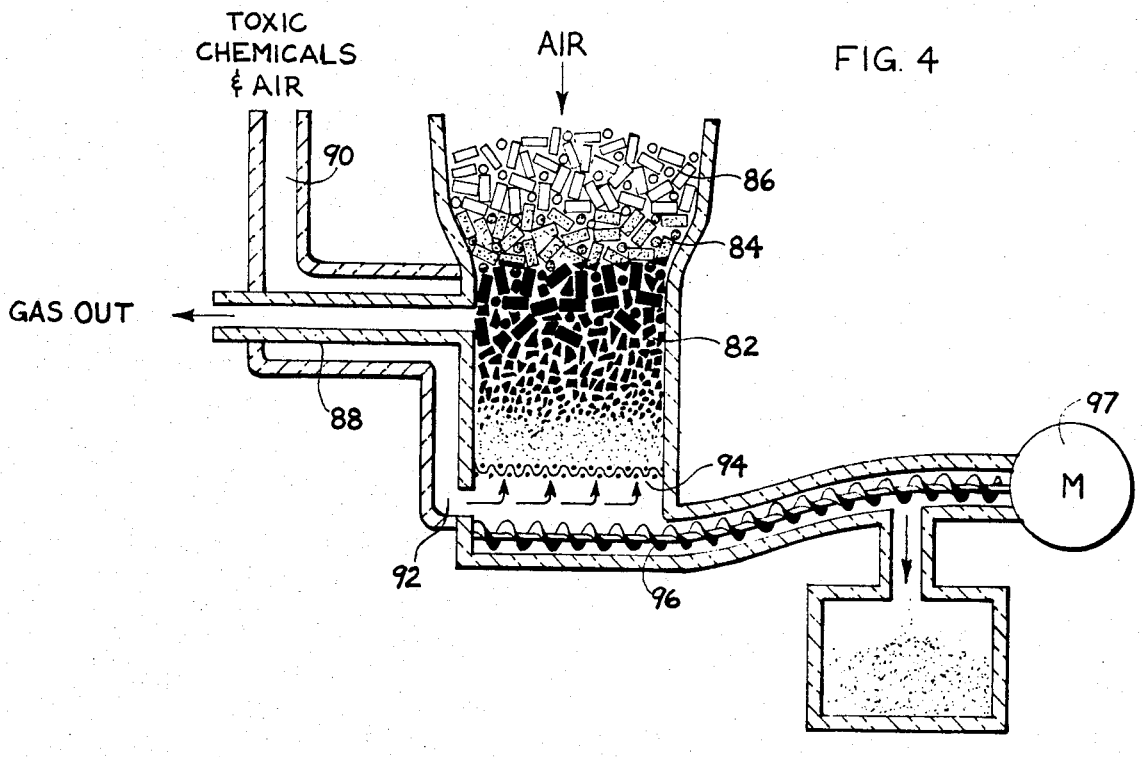
FIG. 4 is a simplified cross-sectional diagram showing a further embodiment which is particularly adapted for the destruction of hazardous chemicals.

FIG. 4 shows another embodiment of the present invention. It is designed specifically to handle the complete destruction of certain extremely toxic chemical substances such as chlorinated hydrocarbons, and other chemical compounds which are formed as a byproduct of particular industrial processes. In this embodiment, a reaction vessel 80 contains a bed of charcoal 82, a reaction zone 84, and fuel head 86 in relative position to each other in much the same manner as the corresponding zones in the embodiments of FIGS. 1–3.

However, instead of the exit line 88 being taken from the bottom of the charcoal bed, it is instead positioned so that it exits the reaction vessel slightly below the pyrolysis zone 84. As in the other embodiments, the temperature of the fuel gas in the exit line 88 is quite high, approximately 800° C. An entry line 90 surrounds a portion of the exit line 88 adjacent the reaction vessel 80, before its connection to the reaction chamber at entry point 92, which is located in the side wall of the reaction vessel 86, near the bottom thereof, just below a screen 94, and just above the ash removing auger 96, which is powered by motor 97. The auger 96 is positioned at the very bottom of the reaction vessel. Thus, there will typically be an empty space beneath the screen 94 to permit the material or gas in the entry line 90 to move upwardly into the charcoal bed 82 from beneath screen 94.

In operation, PCBs or other dangerous chemicals are directed into entry line 90, along with a quantity of air. As the entry material moves through the entry line, it, along with the air, is raised in temperature to approximately 900° C., which is sufficiently high to destroy most, if not all, of the PCBs or other dangerous chemicals. The entry material moves into the reaction vessel at entry point 92 and then upwardly through the screen into the hot charcoal bed, which typically is at a temperature of 950° C. The movement of the entry material through the hot charcoal bed 82 acts as a second stage of destructive heating for the PCBs. The entry material then moves out of the reaction vessel through the exit tube 88, along with fuel gas produced by the pyrolysis zone, from where it either may be burned again, such as fuel for a blast furnace, or may be directed to an internal combustion engine or similar device. This is a third stage of destructive heating, which virtually guarantees the destruction of all of the PCBs or other toxic chemicals in the entry material.

The directed movement of air into the reaction vessel at the bottom of the unit has an additional benefit in that it results in an increase in the consumption of charcoal within the gasifier. Thus, if charcoal begins to accumulate in the unit during normal operation, because of the particular input material or the temperature or rate at which the unit is operating, the addition of air, or air mixed with steam, at the bottom of the unit will increase the charcoal consumption rate, so that the production and consumption of charcoal within the reaction chamber may be conveniently balanced.

Further, at very high operating temperatures, i.e. 1050° C. and above, which would ordinarily result in the gasifier developing clinkers, the use of air directed into the charcoal bed from the bottom of the gasifier maintains the size of the slag residue sufficiently small that it typically will drop through the screen 94 to the bottom of the unit, from where it may be easily removed and discarded. The addition of air is also helpful when the operational temperatures are low, such as at idle, i.e. 750° C., which typically results in sufficient slag formation to choke the unit. Again, the additional air to the bottom of the charcoal bed tends to limit the size of the slag pellets so that they can pass through the screen 94. Hence, the amount of charcoal in the unit, and the formation of clinkers can be effectively controlled through the addition of air at the bottom of the unit. Such an arrangement makes the gasifier quite flexible in operation, and particularly appropriate for use in mobile operations, as it is self-sustaining, and can accommodate a wide range in demand, without overproduction of charcoal and without the formation of clinkers of sufficient size to choke the unit. The apparatus described thus requires a minimum amount of supervision by an operator, and has a high operational reliability. Further embodiments utilizing the addition of air to the bottom of the charcoal bed are discussed in detail hereinafter.

Figure 7:
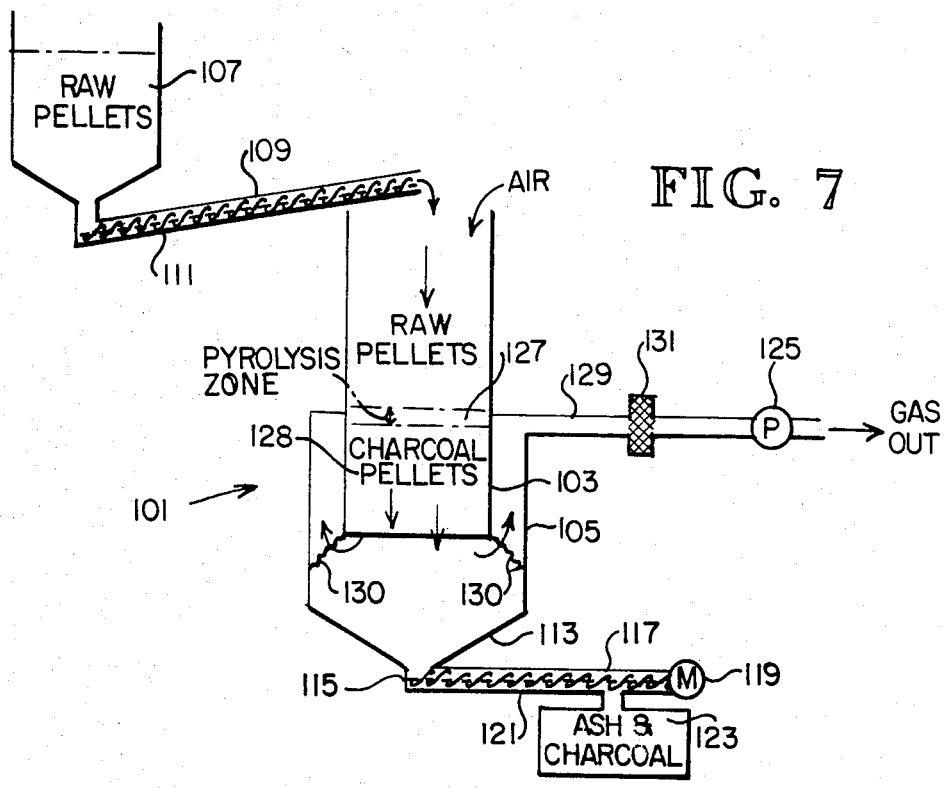
FIG. 7 is a simplified cross-sectional diagram of an embodiment which is similar in concept to the embodiment of FIG. 3, but is somewhat less complex than that embodiment.

FIG. 7 shows another embodiment of the present invention which combines certain features from the embodiments of FIGS. 1 through 4. The gasifier shown generally at 101 comprises a bottomless cylindrical reaction chamber 103, most of which is surrounded by an insulated jacket 105. The insulated jacket extends outward from the reaction chamber a short distance and then downwardly, so that there is a space between the reaction chamber and the insulated jacket. Fuel, in the form of substantially uniform size pellets or chips of biomass, as in the embodiments of FIGS. 1–4, is fed from a storage hopper 107 into the top of the reaction chamber 103 by means of a feed tube 109 and an auger 111.

The lower end portion 113 of insulated jacket 105 is formed in the shape of a cone, with an opening 115 at the bottom which is connected to a charcoal and ash exit tube 117. A motor 119 operates an auger 121, which moves the charcoal and the dust at the bottom of the insulated jacket 105 out of the gasifier into a collection bin 123, from where the charcoal and ash may be conveniently removed.

A pump 125 draws air from the atmosphere down through the reaction chamber 103, establishing a thin, homogeneous pyrolysis zone 127, as described above, in the charcoal bed 128. The fuel gas produced by the gasifier moves downwardly through the devolatilized hot charcoal beneath the pyrolysis zone 127, where any tars are broken down, around the bottom edge 130 of the reaction chamber 103 and then up into the space between insulated jacket 105 and the wall of the reaction chamber, and finally out exit line 129. Any ash or other fines are removed by filter 131 and the gas is directed downstream to an end use, such as a burner or an internal combustion engine. The embodiment of FIG. 7 has similar good ignition and response characteristics as the embodiments described above, although typically, excess charcoal will be produced, which must be periodically removed. Change in demand is accommodated with changes in airflow, produced by the variable rate pump.

Figure 5:
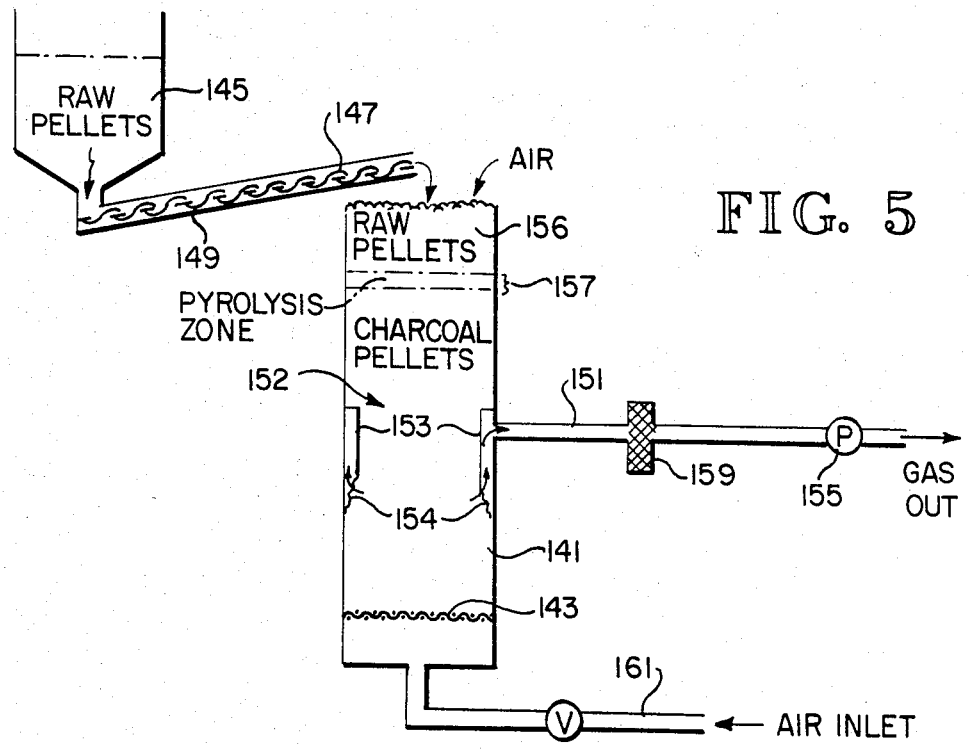
FIG. 5 is a simplified cross-sectional diagram of an embodiment in which air is directed into the reaction chamber from the bottom thereof.
Figure 6:
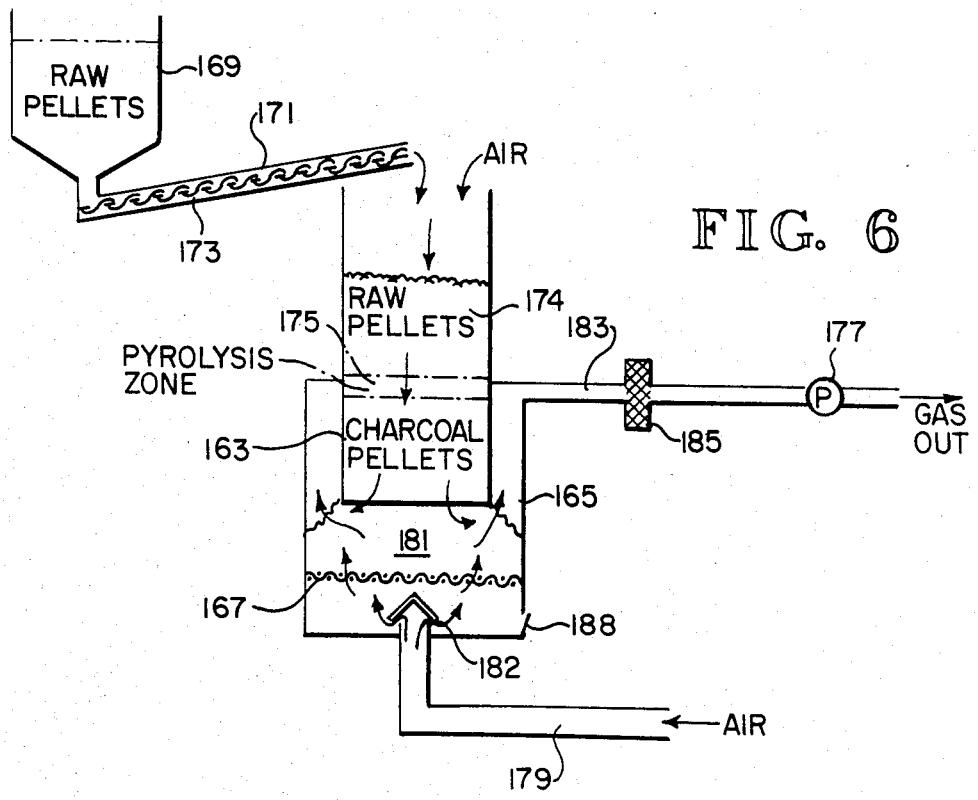
FIG. 6 is a simplified cross-sectional diagram of another embodiment in which air is directed into the reaction chamber from the bottom thereof.

The embodiments of FIGS. 5 and 6, on the other hand, are structured specifically to produce no excess charcoal. The location of the pyrolysis zone in the reaction chamber in the embodiments of FIGS. 5 and 6 remains substantially constant, a substantial operating advantage. In the embodiment of FIG. 5, the cylindrical reaction chamber 141 is 36 inches high and 12 inches in diameter. A screen 143 is positioned 4 inches from the bottom of the reaction chamber, which is fed from a storage hopper 145 through a feed tube 147 by means of an auger 149.

The biomass input, typically in the form of substantially uniform size pellets, with some dust, drop out of the end of the feed tube 147 and by gravity spread themselves over the top of the existing biomass head at the top of reaction chamber 141. Fuel gas exits through an exit line 151 which is located approximately midheight of the reaction chamber 141. A baffle 153 extends around the inside of the reaction chamber 141, also at approximately midheight of the chamber, over the opening in the reaction chamber to the gas exit line. The baffle 153 in the embodiment shown is approximately 8 inches high, and forms an enclosure against the interior surface of the wall of the reaction chamber, with a space of approximately 2 inches between the wall of the reaction chamber and the baffle. The upper portion of the baffle around its circumference is a solid wall, while the lower portion is a screen, permitting gas communication between the interior of the reaction chamber and the space between the baffle and the wall of the reaction chamber, and hence the opening to exit line 151.

In operation, a pump 155 draws air down through the reaction chamber from the atmosphere above the head of raw pellets 156, following ignition of the initial charge of devolatilized charcoal in the reaction chamber, creating a thin pyrolysis zone 157 near the top of the charcoal charge 152, as discussed in detail above. Tar-free gas produced by the pyrolysis zone and the upper portion of the charcoal bed which is immediately beneath the pyrolysis zone moves down through the hot charcoal bed 152, through the screen portion 154 of baffle 153 and out exit line 151. Any ash which exits with the fuel gas is removed by a filter 159.

Additional fuel gas is produced and charcoal consumed in another reaction zone in the lower end of the charcoal bed. Air is directed into the reaction chamber 141 at the lower end thereof through entry line 161. This additional air moves upwardly through the screen 143 into the hot charcoal bed, reacting the charcoal to produce additional fuel gas, and leaving only an ash residue. In the embodiment of FIG. 5, the temperature in the pyrolysis zone 157 is approximately 800° C. to 1000° C., depending on velocity of the air through the reaction chamber, while the temperature in the charcoal bed will be approximately 850° C.–875° C. Thus, if the biomass input to the reaction chamber is such that the pyrolysis action results in the creation of excess char, the additional char is consumed by directing additional air into the reaction chamber from the bottom thereof. Such a device is capable of maintaining an equilibrium of charcoal production and consumption in the reaction chamber, so that no charcoal need be removed from the reaction chamber, and so that pyrolysis zone 157 remains substantially at its original position in the reaction chamber.

The air which is introduced into the bottom of the reaction chamber through entry line 161 may be heated, or steam may be added, to regulate the charcoal-consuming effect within the reaction chamber. Hence, the structure of FIG. 5 combines a downdraft pyrolysis section, producing fuel gas and charcoal, with an updraft charcoal reacting section, which produces additional fuel and an ash residue, which may be conveniently removed from the reaction chamber through a door or the like (not shown).

FIG. 6 shows another embodiment which is an alternative to that of FIG. 5. A bottomless cylindrical reaction chamber 163 is surrounded by an insulated jacket 165 which extends outwardly from the reaction chamber near the upper end thereof, in the vicinity of the pyrolysis zone, and then downwardly, leaving a space between the reaction chamber and the insulated jacket. A screen 167 is positioned a short distance up from the bottom of the insulated jacket 165, but below the bottom edge of the reaction chamber.

Biomass pellets of substantially uniform size are moved from a storage hopper 169 through a feed tube 171 by auger 173, onto the top or head 174 of biomass in the upper end of the reaction chamber 163. As with the embodiment of FIG. 5, fuel gas and charcoal is produced by combustion conversion in pyrolysis zone 175, with pump 177 pulling air from the atmosphere down through the reaction chamber. Additional gas is produced and charcoal consumed in the charcoal-reacting updraft region of the gasifier, with air being moved into the bottom of the reaction chamber through entry line 179, into the charcoal bed 181. The tar-free fuel gas produced in the updraft and downdraft portions of the gasifier moves upwardly into the space between the reaction chamber 163 and the insulated jacket 165 and then out of the gasifier through exit line 183. Filter 185 removes any ash which may be taken out with the fuel gas. The ash residue from the consumption of the charcoal, which falls through screen 167, may be removed through the door 188 in the insulated jacket.

In the operation of the downdraft portion of the gasifier, where the pyrolysis zone is, typically at a temperature of approximately 800° C.–1000° C., carbon monoxide, carbon dioxide, water and hydrogen are produced. The amounts of those gases produced from a given input will be in an equilibrium ratio determined by known equations, with the amounts of each gas for a given unit of input depending upon the carbon, hydrogen, and oxygen content of the biomass input and the operating temperature. The remaining material following pyrolysis will be char. In typical operation of gasifier, as explained above, the typical input is such that more charcoal is produced in the pyrolysis zone than is consumed, although some fuels do not produce excess charcoal.

This problem is eliminated by the action of the updraft portion of the gasifier, which reacts the charcoal in the charcoal bed, which has already been devolatilized by the pyrolysis reaction portion of the gasifier, to produce additional tar-free fuel gas, and a residue of ash, while avoiding plugging and clinkering problems. The temperature of the hot charcoal bed 181 in which this reaction occurs is typically 750°–900° C. The air which is directed into the gasifier through entry pipe 179 is typically warm and moist, although this is not necessary. The amount of moisture in the air, as well as the temperature and velocity of the air, may be varied to regulate the consumption rate of the charcoal in the reaction chamber.

For best operation, the ratio of the cross-sectional area of the reaction chamber 163 to the cross-sectional area of the screen 167 is approximately 1 to 3. It has been discovered that the operation of the embodiments of FIGS. 5 and 6 is optimum at this structural ratio. The air from entry line 179, which is topped by a conical cap 182 in the embodiment shown, being directed into the charcoal bed 181 from below, has a further advantageous effect in that it reduces the plugging problems, found in most gasifiers, caused by the accumulation of small particles of ash. The charcoal bed 181 is continuously agitated by the updrafted air from inlet 179, which causes the small particles of ash to move to the bottom of the charcoal bed, through screen 167, and into the lower end of the gasifier, from which they may be conveniently removed.

The pyrolysis reaction zone in the embodiments of FIGS. 5 and 6, like that of the other embodiments, is relatively thin, due to the homogeneous combustion in the pyrolysis zone, so that any tars which may be produced by the pyrolysis reaction are light and migrate quickly out of the pyrolysis zone; preventing their polymerization into heavy tars in the pyrolysis zone. These tars, if any, which since they do not combine are relatively light, are then broken down by the high temperature and the catalytic effect of the hot charcoal bed beneath the pyrolysis zone. Hence, the fuel gas produced by the downdraft portion of the gasifier, in which the thin pyrolysis zone is located, is tar-free, while the gases from the conversion of the devolatilized char, in the updraft portion of the gasifier, are also tar-free, so that the exit gas in line 183 is essentially tar-free, even over a relatively wide range of operational demand.

Figure 8:
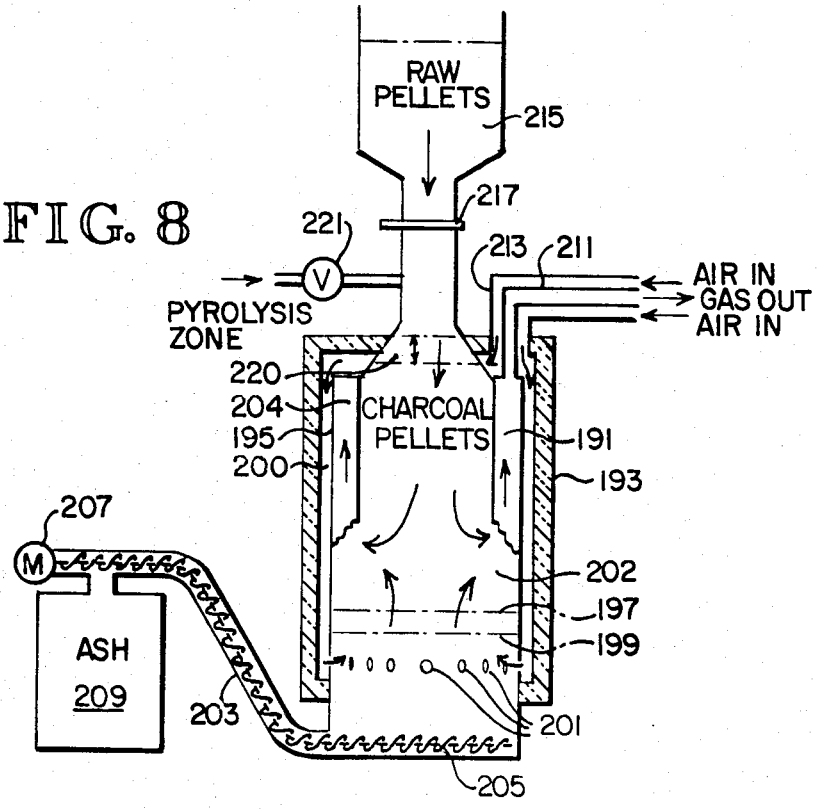
FIG. 8 is a cross-sectional diagram of a detailed embodiment which is similar in general concept to that of FIG. 6.

FIG. 8 shows a more complex variation of the updraft/downdraft gasifiers of FIGS. 5 and 7. A bottomless cylindrical reaction chamber 191 is surrounded by an insulated jacket 193, which extends outwardly from the reaction chamber at a contact point which is approximately midheight of the reaction chamber and then downwardly, substantially parallel with the wall of the reaction chamber. Positioned between insulated jacket 193 and reaction chamber 191 is an intermediate chamber 195 which substantially parallels the configuration of the insulated jacket 193, leaving a space 200 between the insulated jacket and the intermediate chamber. The intermediate chamber 195 is closed at its bottom end, which is below the bottom of the insulated jacket, which mates with the intermediate chamber 195 a few inches from its bottom end.

Upper and lower screens 197 and 199 are positioned in the intermediate chamber, well below the bottom edge of the reaction chamber, but above the point at which the lower end of the insulated jacket joins the intermediate chamber.

In the embodiment shown, upper screen 197 has approximately a mesh size of $\frac{1}{4}$ inch, while lower screen 199 has a mesh size of $\frac{1}{8}$ inch. A plurality of openings 201 are provided in the intermediate chamber adjacent the lower end of the insulated jacket 193, providing a means for fluid communication between the bottom portion of intermediate chamber, in the area beneath the screens 197 and 199, and the space 200 between the intermediate chamber 195 and the insulated jacket 193.

At the bottom of the intermediate chamber 195 is an auger 205, which extends out of the intermediate chamber 195 in an ash exit tube 203. The auger is powered by a motor 207, and moves ash from the bottom of the intermediate chamber 195, where it collects after dropping down through screens 197 and 199, into a collection bin 209. An opening is provided in the top of intermediate chamber 195, adjacent the reaction chamber, from which extends a gas exit tube 211 through which the fuel gas produced by the gasifier leaves the apparatus. A concentric opening to that in the intermediate chamber is provided in the top of insulated jacket 193, through the center of which extends tube 211 and from the edges of which extends an air entry tube 213, so that air enters the space 200 between the insulated jacket 193 and the intermediate chamber 195 around gas exit tube 211.

Fuel is supplied to reaction chamber 191 from a hopper 215 through a closed feeder assembly 217, so that no air reaches the reaction chamber through the hopper/feeder assembly apparatus. The reaction chamber 191 has a particular configuration in the embodiment shown. The chamber includes an upper portion having a fixed diameter, an intermediate portion of increasing diameter, in the form of a truncated cone, and a lower portion of fixed diameter, approximately twice the diameter of the upper portion. The insulated jacket 193 joins the reaction chamber approximately in the middle of the intermediate portion, while the wall forming the intermediate chamber intersects the reaction chamber approximately at the point where the intermediate and lower portions of the reaction chamber meet. An air inlet line 219 controlled by valve 221 provides air to the upper portion of the reaction chamber, where the head of raw pellets is located.

In operation, a pump (not shown) on the gas exit line 211 draws air into the reaction chamber through air inlet line 219 at the desired rate, and then through the reaction chamber in a downdraft fashion, creating a pyrolysis zone 220, typically in the intermediate portion of the reaction chamber. Fuel gas, water and charcoal are products of this reaction, as explained above.

Air is also directed into the space 200 through entry line 213. This air moves through the openings 201 in intermediate chamber 195, near the bottom thereof, into the space beneath screens 197 and 199, and then upwards into the charcoal bed 202, resulting in an updraft consumption of charcoal and production of additional fuel gas. The fuel gases produced by the updraft and downdraft reactions in the gasifier move through the charcoal bed 202 into the space 204 between the reaction chamber and the intermediate chamber and out of the gasifier through gas exit line 211. A cyclone separator and filter may be located in exit line 211 to clean any ash or other particulates from the gas.

The location of the pyrolysis zone in the reaction chamber is generally maintained at a stable position by the consumption of charcoal by the updraft reaction at a rate which corresponds to the production of charcoal in the downdraft pyrolysis region. The cone-shape intermediate portion of the reaction chamber, however, also helps to control the position of the pyrolysis zone. As the pyrolysis zone tends to rise, due to the increasing quantity of charcoal in the gasifier, produced by the pyrolysis reaction, the velocity of the air through the pyrolysis zone will raise the temperature in the pyrolysis zone, so that more of the water produced by the pyrolysis reaction will be utilized. The increased amount of water utilized, converted to steam, will in turn convert an increased amount of charcoal immediately below the pyrolysis zone, thus at least slowing the rise of the pyrolysis zone.

Figure 9:
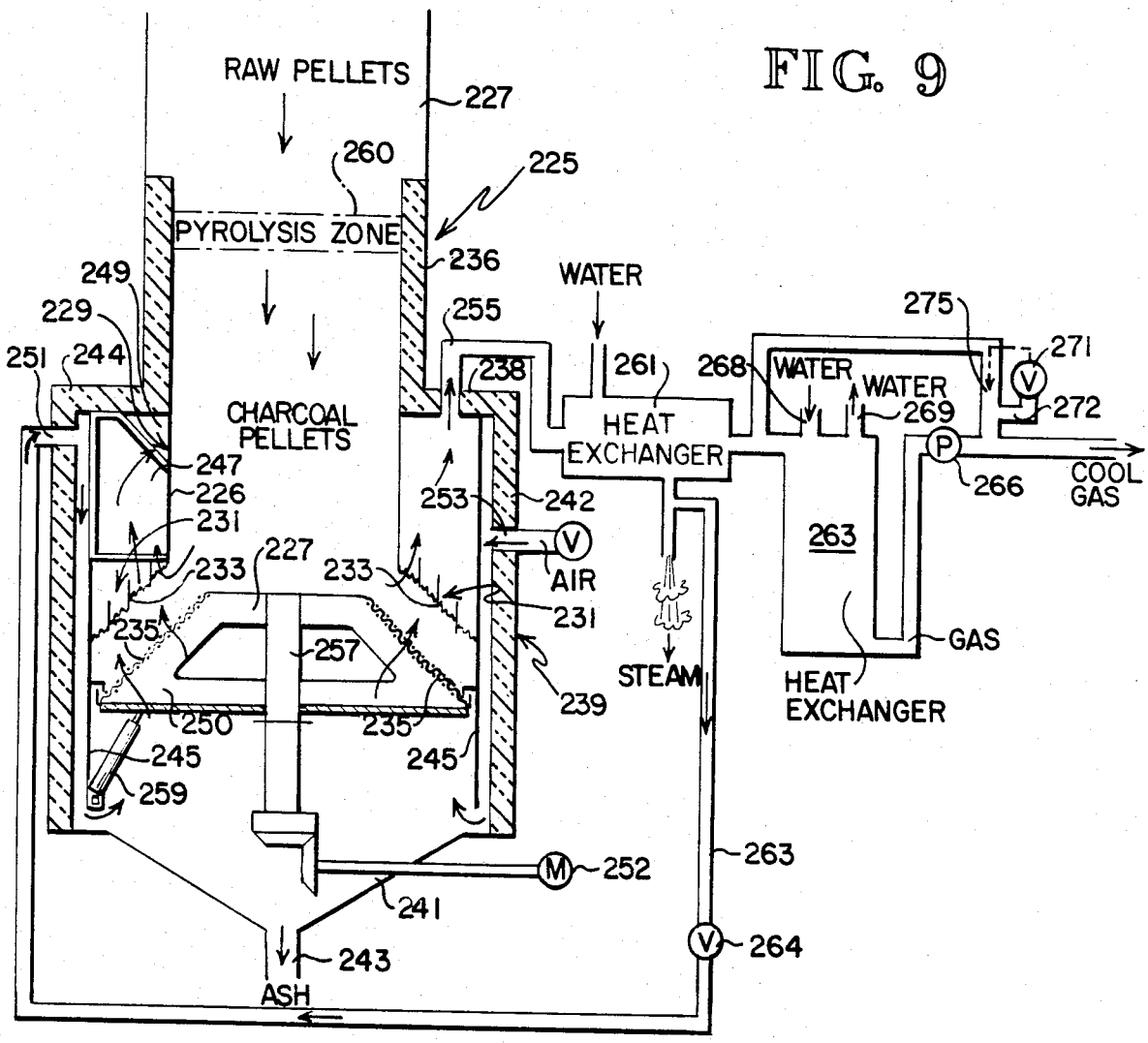
FIG. 9 is a combined cross-sectional and block diagram of a system for producing a cool, tar-free fuel gas which includes a further embodiment of a gasifier in which air is directed into the gasifier from the bottom thereof.

FIG. 9 shows still another embodiment of the downdraft/updraft gasifier, as part of an overall fuel gas production system, which produces a relatively cool (70° F.) tar-free fuel gas, suitable for convenient transportation and/or storage. The gasifier portion of FIG. 9, shown generally at 225, includes a reaction chamber 229, which is fed an input of biomass pellets from a large storage bin (not shown). The input is delivered to a hopper 227 which is positioned on top of, and which has a slightly larger diameter than, reaction chamber 229. In the embodiment shown, the hopper 227 has a diameter of 48 inches, and is 20 inches high. The reaction chamber 229 extends downwardly from the hopper 227, and has a uniform diameter of 40 inches over most of its height, except for a flared section 231 at the bottom thereof.

The flared section 231 is defined by inner and outer boundaries which extend outwardly and downwardly from the main body of the reaction chamber at approximately a 45° angle from the vertical axis of the reaction chamber. The outer boundary is formed by a series of concentric vertical baffles 233 which are open vertically to permit exit of gas from the reaction chamber 229. The inner boundary is formed by a screen 235 which permits the ash residue from the consumption of the charcoal in the reaction chamber to fall out of the reaction chamber.

The vertical distance between the upper and lower boundaries of the flared section 231 will vary because of the configuration of the baffles 233 forming the outer boundary, but it will generally average approximately 10 inches. The uppermost edges of the outer and inner boundaries are both circular in outline, with the upper edge of the outer boundary mating with the bottom edge of the side wall 226 of the reaction chamber 229, while the upper edge of the inner boundary mates with the bottom wall 227 of the reaction chamber, the bottom wall 227 being approximately 28 inches in diameter. Thus, there is an opening between the side wall 226 and the bottom wall 227 of the reaction chamber, leading into the flared section 231.

The reaction chamber 229 is surrounded by an insulated jacket shown generally at 239. An upper portion 236 of the insulated jacket 239 abuts the circumferential wall 226 of the reaction chamber 229 over the upper portion thereof. In the embodiment shown, the height of this portion is approximately 35 inches. The insulation is 1 inch of ceramic fiber blanket and 3 inches of spunglass or ceramic. The outer walls of the other embodiments disclosed herein may, of course, also be insulated, to minimize heat loss. Near the very top of the reaction chamber of FIG. 9, and arranged around the periphery thereof, is a band of fire bricks, which thus surround the reaction chamber and provide additional insulation in the area where the pyrolysis zone is positioned. Also, the fire bricks prevent a wall effect in which the pyrolysis zone tends to creep up the sides of the reaction chamber, resulting in the upper edge of the pyrolysis zone being dished or cone-like.

At a point approximately midheight of the reaction chamber, which in the embodiment shown is approximately 35 inches from the top of the reaction chamber, an intermediate portion 238 of insulated jacket 239 extends outwardly perpendicularly from the reaction chamber to a diameter of 78 inches, from where it extends vertically downwardly for a distance of 72 inches, forming a lower portion 242. The bottom wall 240 of the gasifier is formed in the shape of a cone, extending slightly downwardly and inwardly from the bottom edge of the insulated jacket. There is an opening 243 at the lowermost point of the cone for the purposes of removing the ash from the gasifier. There is a substantial distance between the lower end of the reaction chamber and the bottom wall 241.

A cylindrical interior chamber wall 245 having a diameter of 64 inches extends from the bottom wall 241 upwardly, parallel with the insulated jacket, and joins the insulated jacket at intermediate portion 238. The space 244 between the insulated jacket 239 and the interior chamber wall 245 is to receive steam and air from outside the gasifier. A series of openings near the bottom of the chamber wall 245 provides communication between the space 244 and the space beneath the reaction chamber.

A series of vertical braces 247 connect the interior chamber wall 245 to the side wall of the reaction chamber, thus bracing and providing support for the reaction chamber. The vertical braces 247, which are solid plates, are spaced at uniform intervals around the circumference of the interior of the gasifier. The upper portion of each vertical brace 247 is cutout at 249, leaving a space bounded by the insulated jacket and the wall of the reaction chamber. This space permits fuel gas exiting from the upper boundary of the flared section 231 of the reaction chamber to circulate around the reaction chamber to the exit opening in the insulated jacket.

Two inlets 251 and 253 are provided in the insulated jacket near the top of the lower portion 242 thereof, providing communication between the space 244, formed by the lower portion 242 of the insulated jacket and the interior chamber wall 245, with the exterior of the gasifier. Inlet 251 in the embodiment shown is for steam, while inlet 253 is for air. However, it should be understood that in some cases one inlet could be used to accommodate both steam and air or alternatively, additional inputs for either steam or air or both could be utilized. An outlet 255 in the wall of the intermediate portion 238 of the insulated jacket provides an exit for the fuel gas from the gasifier.

The screen 235, which forms the lower boundary for the flared section of the reaction chamber and the bottom wall 241 of the reaction chamber are supported together about a central vertical shaft 257 which is rotatable, so that screen 235 is rotatable about the central axis of the gasifier. The support structure generally comprises a series of elongated tubes 259, arranged around the periphery of the gasifier, which are connected between bracing shown generally at 250, at the lower end of the reaction chamber, and pads or pockets connected to the bottom wall of the gasifier. The central vertical shaft 257 may be powered by means of motor and appropriate gearing 252 to oscillate the screen 235 so that ash in the lower portion of the reaction chamber falls through screen 235. This tends to prevent plugging of the gasifier.

The gasifier of FIG. 9 operates similarly to that of FIGS. 5, 7 and 8. The initial charge of charcoal fills the reaction chamber nearly to its top. A head of raw biomass input, in the form of uniform size pellets, is fed into hopper 227 from the storage bin, through a feed tube and auger (not shown) or similar engagement. For a gasifier of the size of FIG. 9, the pellets should be approximately in the size of ¼ inch–2 inches. The top of the charcoal bed is then ignited, with air being drawn from the atmosphere down through the hopper and the reaction chamber, forming a thin pyrolysis zone 260 approximately 3 inches deep near the top of the charcoal bed. Although a cap with air openings could be used on the hopper 227, sufficient space must remain at the top of the fuel head to permit the incoming air to disperse evenly over the top of the fuel head. This zone will have a temperature in the range of 750° C.–950° C. The remainder of the charcoal in the reaction chamber will gradually heat up until it reaches a steady state temperature of approximately 875° C.

Tar-free fuel gas moves from the pyrolysis zone down through the charcoal bed, through the flared section 231 and out of the reaction chamber through the baffles forming the upper boundary of the flared section 231. The char produced in the pyrolysis zone is consumed by reacting the charcoal with an updraft of air, principally in the flared section 231. Hot air and/or steam, if necessary, are directed through inlets 251 and 253 into space 244, from where it moves downwardly through the openings in the interior chamber wall 245 into the space beneath the reaction chamber. The air then moves up through screen 235, where it reacts with the charcoal in the flared section 231, resulting in charcoal being consumed, and tar-free fuel gas produced. The volume of the air through screen 235, as well as the moisture content thereof, can be regulated to provide the precise balance between the consumption and the production of charcoal in the reaction chamber.

The fuel gas exiting from the reaction chamber through the baffles 233 moves upwardly from the flared section and then through the cutouts in the vertical braces 247 to the outlet 255. The hot exiting gas is then directed to a heat exchanger 261, in which the heat of the gas is used to produce the steam necessary for the gasifier. The steam is supplied to the gasifier through a line 263, controlled by a valve 264, to inlet 251.

After the gas circulates through the heat exchanger 261, it is directed into another heat exchanger 263 in which the fuel gas is circulated around tubes or the like through which water is directed, which cools the gas down to a temperature of approximately 70° F., which is suitable for transportation in conventional gas pipes. Water enters the cooler 263 through inlet 268 and exits through outlet 269. Pump 266 draws air from the atmosphere down through the gasifier and the gas out the exit line. A valve 271 on the downstream side of pump 266 monitors the pressure present in the line downstream of the system shown in FIG. 9, so that should the gas pressure rise above a particular level, i.e. 2 pounds per inch, due to a shutoff, for instance, of a furnace or other device on the line, control valve 271 opens a butterfly valve 275 in a return line 272, in which excess fuel gas is recirculated back to the input to cooler 265. This relieves the excess pressure on the downstream line while at the same time, gas production from the gasifier is lowered.

Figure 10:
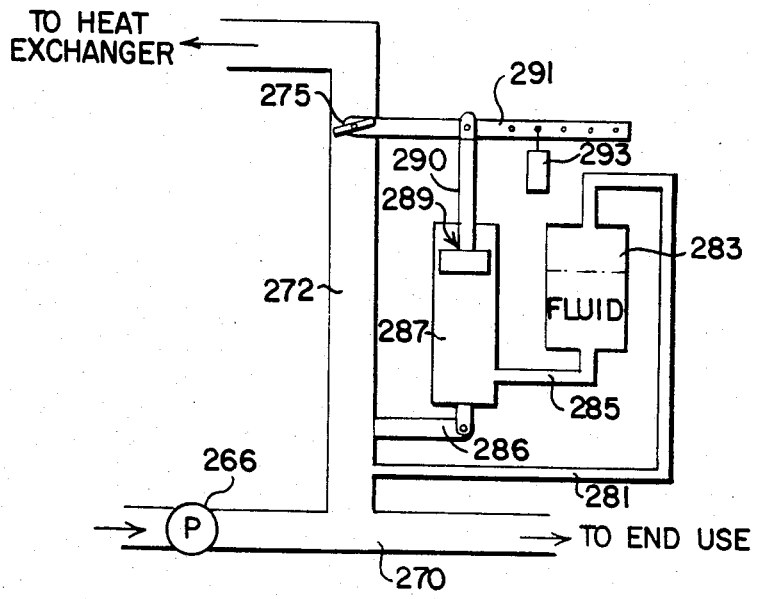
FIG. 10 is a block diagram which shows in more detail a portion of the system of FIG. 9.

The valve 271 is shown in more detail in FIG. 10. Fuel gas from pump 266 normally moves through line 270 to a downstream use, such as a burner or furnace. Under normal conditions, no fuel gas flows in return line 272 because butterfly valve 275 is closed. The fuel gas does, however, fill a sample line 281, which is connected to an air cylinder 283. The level of the fluid in the air cylinder depends on the pressure of the gas in sample line 281, which is the same as the pressure of the gas in line 270 when butterfly valve 275 is closed. The lower end of the air cylinder 283 is in fluid communication with a hydraulic cylinder 287 by means of a connecting line 285. The hydraulic cylinder 287 is supported by a brace 286 from return line 272. A movable piston 289 is positioned in the hydraulic cylinder, with the level of the head of the piston depending upon the level of the hydraulic fluid in the cylinder 287.

The rod-like top portion 290 of the piston extends up out of the top of hydraulic cylinder 287 and is connected to a calibrated arm 291. One end of calibrated arm is connected to butterfly valve 275 and the other end supports a counterweight 293. A plurality of openings in the calibrated arm permit adjustment of the amount of pressure necessary to open the butterfly valve by moving the counterweight between the openings.

When the pressure in line 270 reaches a pressure above a pre-established amount, as determined by the position of counterweight 293, the pressure on the fluid in the air cylinder 283 will be sufficient to force enough fluid into the hydraulic cylinder to raise piston 289 upwardly sufficiently against arm 291 to open butterfly valve 275. When the butterfly valve 275 opens, fuel gas flows back through return line 272 to the input of the cooler 263, as shown in FIG. 9. Hence, by adjusting the position of the counterweight 293 on arm 291, a desired pressure can be maintained in line 270, regardless of the immediate need of the various devices operating off the line.

Hence, the embodiments of FIGS. 5, 6, 8 and 9 show a device which includes both downdraft and updraft reaction zones, which makes possible the generation of a tar-free fuel gas, while the consumption and production of charcoal within the gasifier itself is in balance. The residue is a clean ash, which may be conveniently removed from the gasifier. Such a gasifier is able to operate for extended periods of time, producing tar-free fuel gas, without developing conventional problems of plugging and clinkering. The units disclosed herein are capable of high energy production, with the one shown in FIG. 9, for instance, being designed to provide 3,000,000 BTU per hour. Even larger gasifiers with greater energy output capacity can be made utilizing the principles of the above embodiments.

Although an exemplary embodiment of the invention has been disclosed herein for purposes of illustration, it should be understood that various changes, modifications, and substitutions may be incorporated in such embodiment without departing from the spirit of the invention as defined by the claims which follow.

What is claimed is:

1. A continuous process for producing fuel gas from biomass input material in which the production and consumption of charcoal is substantially in balance, the process comprising the steps of:

Establishing a gas production bed in a single reaction chamber which has an outlet means for fuel gas, the production bed comprising in sequence (a) an upper layer of biomass input material, (b) an intermediate pyrolysis zone layer in which the input material is reduced to devolatilized char and pyrolysis volatiles comprising hydrogen, carbon monoxide, water vapor and tars, the intermediate layer being at a temperature within the range of 800 degrees C. to 100 degrees C., and (c) a lower layer comprising substantially only hot charcoal, the hot charcoal being at a temperature which is sufficiently high to reduce any tars from the pyrolysis zone layer to carbon monoxide and hydrogen;

Adding biomass input material to the top of the upper layer as the input material in the upper layer is consumed during the process;

Moving oxygen-containing gas downwardly through the gas production bed to sustain the pyrolysis reaction in the intermediate layer and to maintain the temperature of the charcoal in the lower layer, wherein the pyrolysis volatiles from the intermediate layer move downwardly through the hot charcoal in the lower layer, resulting in tar-free fuel gas, which exits from the outlet means;

Moving additional oxygen-containing gas upwardly through the lower layer, the additional oxygen-containing gas reacting with the hot charcoal in the lower layer to produce additional tar-free fuel gas, which exits from the outlet means, as well as consuming hot charcoal in the lower layer; and Regulating the introduction of the additional oxygen-containing gas so that the level of charcoal comprising the lower layer, and hence the level of the pyrolysis zone comprising the intermediate layer, remain substantially constant within the reaction chamber.

2. The process of claim 1, wherein the step of regulating includes regulating at least one of the following characteristics of the additional oxygen-containing gas: (a) the flow rate, (b) the temperature, and (c) the moisture content.

3. The process of claim 1, including the step of adding steam to the additional oxygen-containing gas.

4. The process of claim 1, including the step of monitoring the level of the pyrolysis zone in the reaction chamber.

5. The process of claim 1, including the step of removing the fuel gas from the reaction chamber at a point which is substantially above the lower end of the charcoal bed.

6. The process of claim 1, wherein the temperature of the pyrolysis reaction zone is in the range of 800° C.–1000° C.

7. The process of claim 1, including the step of continuously agitating the charcoal base material.

8. The process of claim 1, wherein the pyrolysis reaction zone is relatively thin compared to the length of the charcoal base material.

9. The process of claim 1, wherein the additional oxygen-containing gas is introduced in a toroidal pattern over the bottom surface of the charcoal base material.

10. The process of claim 1, wherein the charcoal base material is substantially completely devolatilized.

11. The process of claim 1, wherein the charcoal base material is substantially uniform in size.

* * * * *

UNITED STATES PATENT AND TRADEMARK OFFICE

CERTIFICATE OF CORRECTION

PATENT NO. : 4,530,702

DATED : July 23, 1985

INVENTOR(S) : Wayne A. Fetters, Donald E. Chittick

It is certified that error appears in the above-identified patent and that said Letters Patent are hereby corrected as shown below:

Claim 1, line 36, the number "100" should be --1,000--.

Signed and Sealed this

*Third* Day of *December 1985*

[SEAL]

*Attest:*

DONALD J. QUIGG

*Attesting Officer*

*Commissioner of Patents and Trademarks*